US008728258B2

(12) United States Patent
Doty

(10) Patent No.: US 8,728,258 B2
(45) Date of Patent: May 20, 2014

(54) SEQUENTIAL AGING OF ALUMINUM SILICON CASTING ALLOYS

(75) Inventor: Herbert W. Doty, Amherst, NH (US)

(73) Assignee: GM Global Technology Operations LLC, Detroit, MI (US)

( * ) Notice: Subject to any disclaimer, the term of this patent is extended or adjusted under 35 U.S.C. 154(b) by 460 days.

(21) Appl. No.: 12/136,257

(22) Filed: Jun. 10, 2008

(65) Prior Publication Data

US 2009/0301617 A1 Dec. 10, 2009

(51) Int. Cl.
*C22F 1/043* (2006.01)

(52) U.S. Cl.
USPC ..... 148/694; 148/698

(58) Field of Classification Search
USPC ..... 148/690, 693, 694, 549, 697–702
See application file for complete search history.

(56) References Cited

U.S. PATENT DOCUMENTS 5,700,424 A 12/1997 Matsuo et al.
5,837,070 A 11/1998 Sainfort et al.
6,679,958 B1 * 1/2004 Tundal et al. ..... 148/690
7,494,554 B1 * 2/2009 Donahue et al. ..... 148/698
2003/0041934 A1 * 3/2003 Lumley et al. ..... 148/698
2006/0070689 A1 * 4/2006 Kropfl ..... 148/698

FOREIGN PATENT DOCUMENTS

DE 201 01 474 U1 6/2001
DE 103 12 394 A1 9/2004
EP 0 717 784 B1 9/1998
EP 1 195 449 A2 4/2002

OTHER PUBLICATIONS

Aluminium-Taschenbuch, 14. Auflage, 1983, Aluminium-Zentrale Dusseldorf, S. 131-134 and 431-434.

* cited by examiner

*Primary Examiner* — Roy King
*Assistant Examiner* — Janelle Morillo
(74) *Attorney, Agent, or Firm* — Dinsmore & Shohl LLP

(57) ABSTRACT

Aluminum castings having increased elongation and tensile strength are obtained by sequential aging a solutionized casting followed by rapid heating to nucleation temperature followed by rapid cooling, then reheating to precipitate growth temperature.

19 Claims, 4 Drawing Sheets

SEQUENTIAL AGING OF ALUMINUM SILICON CASTING ALLOYS

BACKGROUND OF THE INVENTION

1. Field of the Invention

The invention pertains to a step aging process for aluminum silicon alloy castings capable of increasing both the tensile strength and the elongation of the casting. Complex castings having both thin and thick sections may be heat treated without excessively averaging the thin sections.

2. Description of the Related Art

Aluminum silicon alloy castings are produced in high volume for diverse applications. In many of these applications, for example cylinder blocks and heads, transmission castings, and the like, the castings may be quite complex, and more often than not, have portions of the casting with thick sections, for example crankshaft webs, while other portions have thin sections. To obtain adequate physical properties such as tensile strength, elongation, and hardness, aluminum silicon castings are generally subjected to a heat treatment.

The most popular Al—Si casting alloys (e.g. 319, 356, 390) are strengthened through the mechanism described as age hardening or precipitation strengthening. The process usually consists of three steps; first, the alloying elements are dissolved into the aluminum solid solution at an elevated temperature. This step is called the solution treatment and is usually performed as a separate operation from the casting process. After solidification, the casting is removed from the mold and then placed in a separate furnace to be reheated to a temperature just below the solidus and held for a period of time sufficient to dissolve precipitates and saturate the ∀ aluminum phase with solute atoms (usually Cu and/or Mg). In addition, some speroidization of the insoluble particles (such as silicon) will accompany "solutionizing."

Following solutionizing, the casting is rapidly cooled during the second step of the precipitation strengthening process, termed "quenching." The quench must be rapid enough to restrict diffusion and prevent the solute atoms from precipitating out of solution. A requirement of effective solute elements is that the maximum solubility in aluminum must increase with temperature, so that when the temperature is rapidly lowered, the aluminum will contain more than the equilibrium solute content and become "super-saturated." The super-saturated state is a non-equilibrium state. Since the super-saturated aluminum composition contains more than ten times less solute atoms than the precipitate, solute atoms must cluster together to form regions of higher solute concentration and leave other areas of reduced solute concentration before a precipitate can form.

The difference between the equilibrium solute concentration in solution at the solution temperature and the equilibrium solute concentration in solution at the aging temperature provides the driving force for the precipitation reaction. The lower the aging temperature, the higher is this difference and therefore the higher is the driving force. Conversely, the lower the temperature, the lower is the atomic mobility.

Thus, the precipitation reaction is governed by the trade-off between the compositional driving force against the temperature-controlled atomic mobility. Some precipitation occurs even at room temperature. At low temperature the compositional driving force is high, but since the atomic mobility is low, the diffusion of solute atoms is slow and therefore the precipitation reaction is sluggish. At higher temperatures, the atomic movement is amplified making cluster-formation more rapid, but the compositional driving force is lower, resulting in a lower quantity of precipitate forming.

The choice of aging temperature in conventional heat treatment is a trade-off between reaction rate and the total amount of precipitate formed. The hardness and strength of the component is strongly controlled by the amount of precipitate formed during aging, the casting is reheated to an intermediate temperature to nucleate the strengthening precipitates. The precipitation reaction itself is a multi-step process, causing the strength and hardness of the casting to rise with time and temperature through some peak hardness value, and then decrease again. When the aging temperature is increased, peak hardness is obtained in a shorter time, but at some expense to the level of peak hardness. Thus, there is an optimal combination of temperature and time resulting in an optimum compromise between peak strength and process time constraints.

Control of each of the above steps is vitally important to achieving the combination of strength and ductility for the particular service application. Some castings are purposely aged at higher temperatures or for longer times to obtain a condition past peak hardness. This "overaged" condition exhibits a lower tensile strength than the peak aged condition, but the increase in tensile elongation (damage tolerance) and dimensional stability can be more important than strength in many applications.

The precipitation reaction involves a diffusion-controlled agglomeration of atom clusters to form zones rich in solute. At a later stage, a discrete phase precipitates from this zone. This clustering and precipitation causes strength to increase by the increase in localized lattice strain. Still later, the precipitates grow in size until the total system energy can be decreased by formation of an interface. At this point, the particle becomes an incoherent phase and the lattice stain decreases significantly with an accompanying drop-off in hardness and tensile strength. The precipitation of the particles is also accompanied by changes to the physical dimensions of the casting with time at temperature. Therefore, for applications with critical dimensional tolerances, the casting is heat treated past the peak hardness to the point where most of the dimensional change has occurred and then it is machined to the required dimensions.

The heat treatment of aluminum castings is an energy- and capital-intensive process that can involve up to 2 days or longer of in-process part heat treating at any given time. In addition, because of significant differences in casting microstructure from location to location within the part, the properties, both as-cast and after heat treatment, will vary with location within the part. Thus, microstructure and heat treatment are currently optimized for properties in a given location within the casting. The remainder of the casting may have inferior properties.

In addition, conventional heat treatment results in differential temperature ramps to the solution and aging temperatures due to part geometry driven by relatively poor heat transfer from the furnace atmosphere to the part. This results in different parts of the casting effectively receiving different heat treatments. The quenching operation suffers similar restrictions, although in a compressed time window. However, the reduced time differential still results in severe stress-induced distortion and even cracking resulting from differential cooling.

To compound these difficulties, the thin casting sections that naturally contain the finest microstructure due to the more rapid solidification are exactly the same locations that heat and cool the fastest during heat treatment, for the same reason; more favorable heat transfer geometry. This causes the longest time at temperature in the locations with the shortest diffusion distances as well as the greatest amount of solute already in solution, exactly the opposite of what is desired. Thus, in order to get the desired condition in heavier sections of a casting, other locations will become excessively overaged. However, this is usually partially offset by a significant improvement in properties caused by the refined microstructure caused by more rapid solidification in aluminum alloys. A refined microstructure is beneficial in that it usually causes a reduction in flaw size such as porosity and inclusions. This is independent of heat treatment.

The problems involved with prior art aging processes can be described by referring to FIG. 1. FIG. 1 is a chart of time versus temperature with several temperature regimes highlighted. The horizontal lines in the figure represent physical characteristics of the alloy comprising the casting, which vary depending upon the alloy composition. These are thermodynamic quantities and are independent of microstructural fineness. The Liquidus is the temperature at which solidification begins and the Solidus is the temperature at which solidification is complete. The Solvus line is the temperature above which the solute is entirely in solution; below this the alloy can exist as a two-phase mixture. Therefore, solution treatment is performed at a temperature between the Solidus and the Solvus. The group of horizontal lines between 100 and 200° C. represent various stages of the precipitation reaction. This is the aging regime. For temperatures above the Solvus, the precipitates are dissolving and for temperatures below this line, they are growing and coalescing.

During solution treatment, section 1, a relatively thin section of the casting heats up rapidly to the solution temperature. Section 2, however, is much thicker and takes much longer to reach the solution temperature. Likewise, upon cooling section 2 lags section 1.

The heavy structure of section 2 has relatively large diffusion distances compared to section 1. Section 2 also remains at the solution temperature for a shorter span of time than section 1 due to the time lag to reach that temperature. In addition, section 2 also spends a significantly greater amount of time in the temperature zone below the Solvus, where the precipitates and secondary eutectic phase particles are coarsening. Therefore, as the casting is heating to the solution temperature, the heavy section 2 undergoes farther coarsening even as the precipitates that formed during casting solidification are being dissolved in the thin section 1. Thus, section 2 would require an even longer time at the solution temperature to completely dissolve the precipitate. Since the heavy casting sections also exhibit greater solute coring in the aluminum phase, more time is needed for diffusion to eliminate these concentration gradients.

Upon quenching, section 2, again spends more time in the precipitate growth region, leading to less supersaturation and thus less strengthening potential. However, it is usually just this heavy section that will bear the greatest stresses in the final application, so the process has to be optimized for the properties in this section.

Heating to the aging temperature results in heating rate distributions following the same general patterns as described for the solutionizing treatment. The consequence, however, of the pattern of the heating rate difference is very different metallurgically.

Since the precipitation process is driven by the balancing of compositional driving force against the atomic mobility, and each are affected by the temperature in the opposite direction, it can easily be seen that precipitation will vary throughout the part depending on the differences in temperature. The greater the difference, the larger the variation and thus, the greater is the variation of properties throughout the casting.

As the precipitates begin to form, the hardness and strength increase with time at temperature and the ductility decreases due to an increase in lattice strain energy created by the atomic spacing mismatch between the precipitate and the matrix.

As the precipitates grow, the local strain at the precipitate-matrix interface increases until it reaches a maximum at which the system energy can be reduced by breaking the bonds between the precipitate and the matrix, forming a phase boundary. As more precipitates become separated from the matrix by these boundaries (decoherent with the matrix), the mismatch stress are relieved thereby decreasing the hardness and strength and increasing the ductility. Thus, the common observation is that for a given microstructure, the hardness and strength vary inversely with the ductility.

SUMMARY OF THE INVENTION

It has now been surprisingly discovered that aluminum silicon alloy castings can be heat treated in a sequential aging process which achieves both high elongation and high tensile strength simultaneously. The heat treatment regime involves a heating up to the nucleation treatment by employing an enhanced heat treatment environment followed by cooling, and subsequent reheating to the growth temperature. Thick sections can be aged appropriately while thinner sections experience reduced overaging, resulting in more uniform properties throughout the casting.

BRIEF DESCRIPTION OF THE DRAWING FIGURES

DETAILED DESCRIPTION OF THE PREFERRED EMBODIMENTS

The subject invention thus provides a process whereby the aging curve can be flattened out, giving a broader operating window in damage tolerance-yield strength space so that all areas of the casting can attain reasonable ductility without portions experiencing significant loss in tensile strength. This process can achieve even greater results in cooperation with a higher heat transfer heat treat medium such as fluidized sand bed reactors or molten polymer systems such as Dowtherm® heat transfer media.

Figure 1:
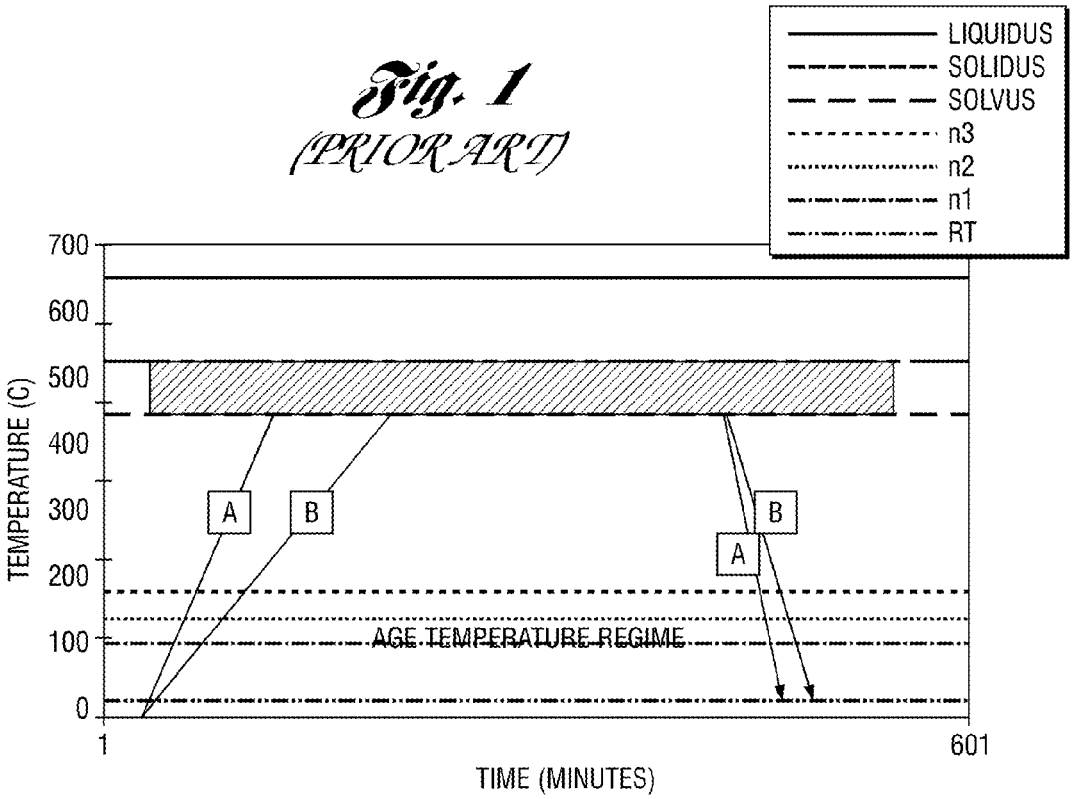
Fig. 1 (PRIOR ART)
FIG. 1 illustrates a prior art solutionizing and aging treatment for a silicon aluminum casting having thick and thin sections.
Figure 2:
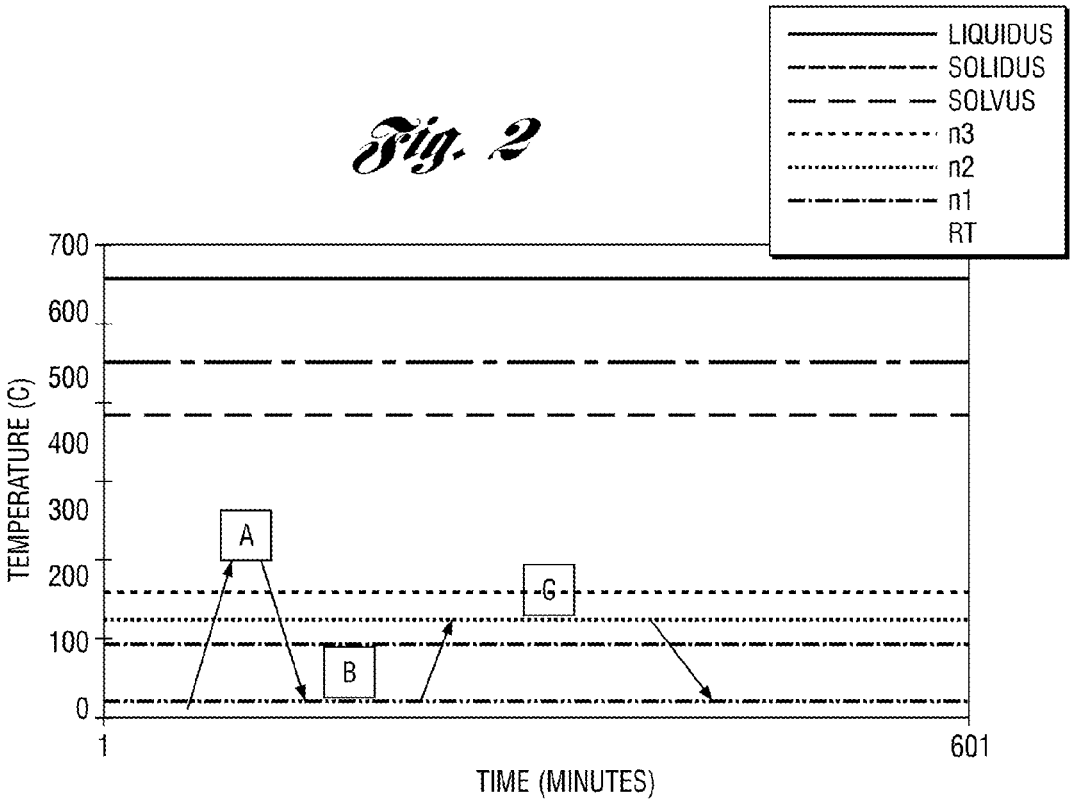
FIG. 2 illustrates a subject invention step aging process which takes place after solutionizing.

In order to counter the prior art difficulties with the aging process, a sequential aging process has been developed. FIG. 2 schematically shows the aging process whereby the nucleation of the strengthening precipitates has been isolated as a separate step from the growth of the same precipitates. Nucleation is a very brief event and is preceded by a period of diffusion-controlled atomic clustering of solute atoms. It is advantageous to compress the timing of the clustering in an enhanced heat transfer environment when castings having both thick and thin sections are involved.

The step aging cycle can be broken down into three events. The first step, indicated by point 3 in FIG. 2 is a rapid heat up to the nucleation temperature. In this step it is advantageous to heat the entire casting to the nucleation temperature as rapidly as possible to avoid excessive growth in the first precipitates to form. Additionally, the holding time will be brief, only enough to activate the nucleation sites. This is not instantaneous, as some atom clustering must first take place, but it is rapid, on the order of tens of minutes.

From the nucleation event, the casting is cooled to retard the growth of earlier nucleating particles. This may not require reducing the temperature all of the way to room temperature, but the temperature drop should be significant; about 100 degrees F., or more. A hold at room temperature or the lower temperature may be necessary to stabilize the precipitates, point 4 in the figure. Finally, the casting is reheated to the growth temperature which is at a lower temperature than the nucleation temperature to increase the compositional driving force for precipitation and increase the equilibrium volume fraction of precipitates. The length of time at the growth temperature determines the degree of particle coherency and the temperature distribution patterns during heating and cooling, coupled with the prior microstructure, control the variation throughout the casting. The precipitation hardening sequence described in the prior art for age hardening aluminum alloys consists of initial formation of GP zones which later transform into Θ" and then into Θ" phase with further time at temperature. The inventive process may either bypass the initial distinct phases transformations by nucleating at a higher temperature, or this sequence may proceed too rapidly to be detected. Regardless of the path, the final state is of primary importance in the development of mechanical properties. Quenching from the nucleation to the growth temperature may also be possible, provided precise and rapid thermal conditions are managed properly.

In an alloy development study, an excess density of Θ' precipiates was found in modified Al—Si—Cu alloys. In order to determine the origin of these excess precipitates, research was undertaken to follow the nucleation and growth events separately during the aging treatments. The tensile results for 319 alloy modified with strontium were measured, from chilled and unchilled sections of the same casting, heat treated to the T6, T7 and sequential aged tempers. The T6 temper is peak hardness, T7 temper is overaged, and step aged is the process of the present invention whereby strengthening precipitates are first nucleated by a brief high temperature excursion, then cooled to room temperature followed by a longer exposure to a low aging temperature.

In these strontium-modified alloys, step aged samples show a slight drop in tensile strength compared to the T6 but an increase in tensile elongation compared to the T7 condition, especially at Mn/Fe ratios of 1.0 to 1.45. The results are even more significant in the unchilled regions. Larger scale microstructural features as well as the presence of 0.5 to 1.0% microporosity, both of which are detrimental to tensile properties, especially elongation, characterize the unchilled regions in all of the castings.

The results for castings produced without chemical modification with strontium were also studied. In this set, the grouping of chilled and unchilled results is not quite as pronounced. Although the chilled properties are still higher there is some overlap between the chilled strength of the T7 group and the unchilled strength of the T7 group. However, the tensile elongation shows complete separation between the chilled and unchilled specimens regardless of temper. Again the important feature to note is that the step aged temper has tensile strength approaching the peak strength (T6) but elongation exceeding that of the overaged (T7) condition.

Another important feature is a change in the location of peak values with Mn/Fe ratio and eutectic silicon modification. It is important to note that the optimum heat treatment will not only be a function of the desired property ranges as dictated by the application, but also the composition of the alloy will affect the composition and microstructure of the casting.

For higher silicon aluminum (Al-11, Si-2.25, Cu-0.3, Mg-0.4, Fe-0.55, Mn-0.02, Sr) alloys, the hardness and tensile properties were measured for different times at the secondary aging temperature. In this series of tests, all castings were first solution treated and quenched utilizing an identical process: 910 F for 8 hours, followed by a quench into hot (120-140 F) water. The hardness remains essentially flat or even drops for the sequential aged castings whereas the 380° F. (T6) and 440° F. (T7) aged alloys both undergo a characteristic increase to a peak, then decrease.

Figure 3:
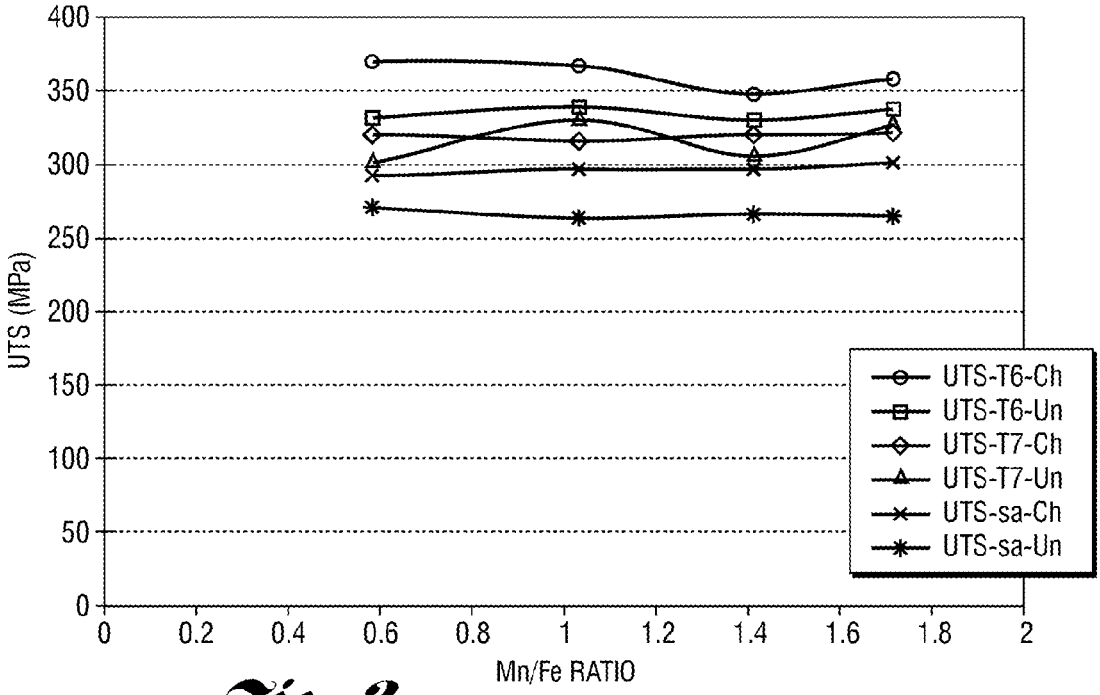
FIGS. 3 and 4 illustrate the benefits of the step aged process versus conventional aging.
Figure 4:
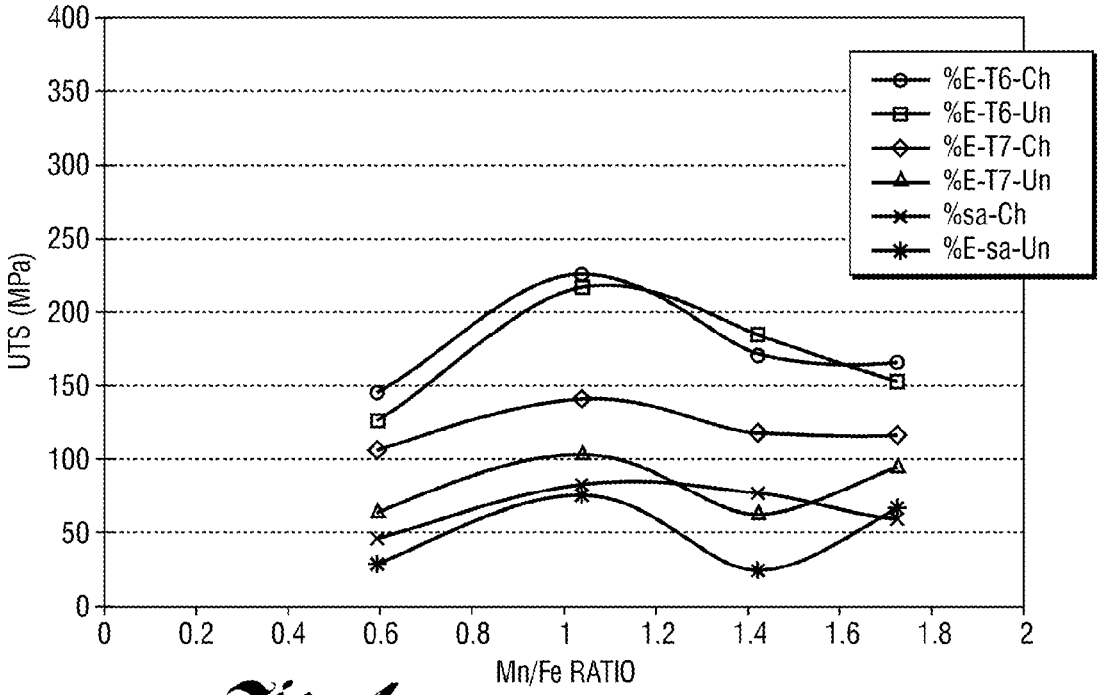

In FIGS. 3 and 4, however, the unique features of this heat treating process are illustrated. FIG. 3 shows the ultimate tensile strength in both chilled and unchilled sections of sand castings. For sequential aging as well as more traditional T6 and T7 treatments, there is a significant decrease in strength without the chilled microstructure. This feature is even more pronounced in FIG. 4 for the tensile elongation. However, as the second aging treatment in the step aging cycle proceeds from 120 to 240 to 360 minutes, a corresponding increase in the tensile strength as well as the percent elongation occurs. Moreover, these changes proceed as the Brinell hardness actually decreases. In fact, the peak in strength and elongation might not have been attained by 360 minutes. The test was terminated at 360 minutes based on decreasing hardness levels, but it is now known that this is an unreliable guide, as the ordinarily observed relationships between hardness and strength properties surprisingly do not occur in step aged castings.

The unexpected results whereby both tensile strength and elongation are improved in tandem while the overall casting hardness does not appear to be significantly affected allows tailoring the properties of aluminum-silicon casting alloys in ways not previously believed possible. In addition, it appears that the effect is even greater in the lower-strength unchilled regions of castings. This is especially good news to designers who have had to compromise designs due to the limited extent that chilling is possible within a given casting.

Another surprising factor is the flat hardness curve. It is assumed that a spread of heat treatments throughout a complex casting is to some extent unavoidable. However, if hardness is a good measure of the machinability of a casting, more uniformity in metal removal during machining is expected. This allows engineers to set up the machining process using more optimal machine tools, feeds and speeds, compared to conventionally processed castings where the worst-case machinability location dictates the machine set-up parameters. These factors can greatly improve throughput and tool life. Combination of the sequential aging process with more uniform thermal exposures utilizing a fluidized bed furnace or liquid heat treatment process should reduce these variations by an even greater amount.

The important features of the proposed sequential age heat treatment process are:

1. Rapid formation of atomic clusters. This is accomplished by heating throughout the part to a temperature well in excess of the temperatures usually employed to achieve peak strength.
2. Interrupted growth of all precipitates. Cooling to a temperature of limited diffusion capability as rapidly as possible immediately after the nucleation event for the most precise control.

3. Controlled growth of all precipitates in a uniform manner. This will take place at a temperature that is slightly lower than conventional aging.
4. Greater maximum volume percent of precipitates. Lower final age temperature results in higher equilibrium volume of precipitate phase.

The optimum cycle will vary as a function of composition and microstructure, but can be determined by one skilled in the art without undue experimentation. For a given alloy, relationships to examine include one or more of: the heating rate to nucleation temperature, the nucleation temperature, nucleation time at temperature, intermediate quench rate, intermediate temperature drop required to stop growth, hold time at the no growth temperature, quenching directly from the nucleation temperature to the secondary age temperature, the secondary age temperature, the secondary age time (hardening curves), the secondary cooling rate. Many of these parameters are already known for a given alloy.

The age nucleation step for heating treating aluminum casting alloys has thus been developed as a means to attain combinations of mechanical properties that have not previously been attained. Another significant benefit is the reduction in the variation of properties within a casting caused by the complex interaction of microstructure and local thermal profile. The process described previously is augmented in the next few paragraphs, and illustrated in a non-limiting way by actual examples.

The age nucleation step is a brief higher temperature excursion timed after quench and before artificial aging of the typical solution-quench-age aluminum precipitation aging cycle employed in the industry. The purpose of this step is to accelerate the nucleation of hardening precipitates within the aluminum matrix. It is generally believed that several nucleation events occur during aging, with optimum properties achieved when the third stage out of four is reached. The sequence is (1) G.P. zones nucleate, (2) Θ" precipitates nucleate at the expense of the G.P. zones, (3) Θ' precipitates nucleate (if it not clear whether these grow from the Θ" precipitates or are a separate nucleation event), (4) finally, the stable Θ phase nucleates. The first three precipitates are coherent with the matrix and lead to increasing lattice strain and resistance to dislocation movement in order from G.P. Θ"Θ'. The fourth phase is characterized by an incoherent interface with the matrix and leads to a large reduction in lattice strain and therefore a reduction in hardness and strength and is referred to as the over-aged condition. The final transition to the stable phase is thought to be a purely growth-controlled process (i.e., no new nucleation event).

During the aging treatment, the cooled casting is introduced into a furnace at the aging temperature to be heated. The external parts of the casting, with highest surface area to volume ratio will heat more rapidly than the thicker, interior sections. This leads to some parts of the casting arriving at the rapid diffusion temperature long before other sections. Usually, these are precisely the locations that have the refined microstructure, higher density of nucleation sites and the higher driving force for precipitation.

Thus, for the age nucleation cycle to be employed, the difference in heating rate of the various sections of the casting must be less than a critical value. It is this difference that determines the degree to which the properties can be optimized. The larger the difference, the less will be the impact. If conventional heating is employed, the effect of the age nucleation step is a minimum, but it is still a significant improvement over conventional single-step aging.

To determine the effect, the variation in microstructure within the casting (the local solidification rate), the effectiveness of the solution treatment and the local heating rate differences within the casting must be known. Heating rate is controllable only to a minor degree in conventional forced-air furnaces. However, heating in molten salt bath or a fluidized bed furnace can significantly alter the heat rate and the differential heating of the casting. However, the heating rate and differential heating will still be controlled by convection to and conduction through the casting and will therefore be almost constant (but a different constant than the forced-air furnace). This will enable testing at significantly different heat rates and differentials for the same castings. A new magnetic heating method, called Core Thermal Technology (CTT), patented by MTECH, promises to enable variation of the heating rate and therefore determine and control to an optimal level. It is expected that entirely new combinations of properties can be achieved with this type of control. The average heating rate is preferably about 1.5° F./min or more, more preferably ≥2° F./min, yet more preferably ≥3° F./min, still more preferably ≥5° F./min, and most preferably ≥10° F./min.

In conventional batch heating processes of large industrial castings (approximate 100 pound cylinder blocks), the central portion of the casting can take up to 2 hours to heat to 400° F., whereas the thin bell housing section can approach 400 in 30 minutes. The minimum heating rate is 2.75° F./min and the maximum is 11. The differential is 8.25° F./min. For experimental test pieces of one pound, we achieved a differential of less than 2° F./min with the same minimum of 2.75° F./min. This resulted in the strength and elongation improvements described previously. The differential is preferably less than or equal to 7° F./min, more preferably ≤5° F./min, still more preferably ≤3° F./min, and most preferably ≤20° F./min.

Finally, the age nucleation cycle was found to be effective at 30 minutes and 60 minute soak time, and if it takes 120 minutes to reach temperature, the practicality of using this cycle is lost. Thus, there is a need to reach the age nucleation temperature (400 to 500° F.) preferably within 60 minutes at the slowest heating section of the casting (minimum heating rate of around 7.2° F./min. Slower heating will result in proportionately less remarkable results. The minimum heating rate to detect any effect is not known, but it is known that maximizing the heating rate in the slowest heating section of the casting is desirable.

Thus, it is important that a heating means is employed which allows the slowest heating section of the casting to reach the age nucleation temperature in 100 minutes or less, preferably 90 minutes or less, yet more preferably 60 minutes or less, and most preferably 30 minutes or less, each time within these ranges being regarded as being specifically disclosed herein. In order for these heating rates to be obtained, the means of heating must be selected to have a high heat transfer rate. In general, ordinary furnaces do not have this capability. Suitable furnaces will depend upon the part geometry and in particular upon the relationship between thick and thin sections. For castings where this difference is moderate, an air oven with rapid forced air (jet) circulation may be sufficient. However, for most castings of reasonable complexity, a higher heat transfer rate must be used. This is true even when there are no thin sections of the casting, only thick, even uniformly thick sections, as in such castings, the rate of heating of the exterior and interior come into question, and physical properties may vary upon distance from the surface of the casting.

It is preferred that a higher heat transfer rate than can ordinarily be achieved by forced air alone be used. Examples of such heating means include high temperature oils, such as those sold under the trademark Dowtherm™, molten salt baths, and fluidized bed furnaces where particles in the fluidized bed transfer heat to the casting. A jet air furnace may also be employed. In such a furnace, castings are oriented in a fixed position as they enter the furnace, which may or may not have forced air circulation. Jets of higher temperature air are directed at the most massive (thick section) portions of the casting. These jets may be robotically controlled. As a result, the time to temperature of these portions of the casting is lowered, and will thus be closer to that of the thin sections of the casting. The thin sections may also be insulated or partially shielded, either from the general hot air of the furnace, or the hot air jets, again lowering the differential heating rate.

Likewise, for steps of the aging process which require cooling, the cooling means is selected so as to provide the desired cooling rate. It is most desirable that the differential cooling rates in the casting are minimized, and thus again, fluidized bed coolers, water, or oil baths may be conveniently used. Salt baths with a low melting point may also be used. In both heating and cooling when using baths, it is desirable for the bath to be stirred or otherwise agitated.

Having generally described this invention, a further understanding can be obtained by reference to certain specific examples which are provided herein for purposes of illustration only and are not intended to be limiting unless otherwise specified.

A designed experiment was run in which a 2-stage aging process was used in place of the conventional single temperature soak after solution treatment and quench. The first aging step was 30 minutes at temperature and the second step was held for 6 hours at the lower temperature. An enhanced heat transfer heating method consisting of a fluidized bed was used to heat castings in accordance with the invention. For comparison, a conventional recirculating air furnace was utilized. In addition, to simulate the heating rate in a conventionally-loaded production process for aluminum cylinder blocks, a third condition was utilized in which the test pieces were wrapped in fiber blanket (Kaowool™). The results show a significant improvement in hardness with heating rate. For tensile properties, the data indicate using a high heat rate for only one of the aging steps is warranted; for higher strength, a higher heating rate should be used during the first age cycle, for higher ductility a high heating rate in the second stage is indicated. In both cases, the combination of strength and ductility is superior to conventional heat treatment when a double aging is utilized. The heating rate ranged from 0.05° F./s in the fiber blanket wrapped parts to 2.8° F./s for fluidized bed treatment. Higher rates up to 20° F./s and higher are believed to be useful.

Procedure

Ten "grate" mold castings were produced from one heat of B319 aluminum alloy (see Table 1). One of the castings was cast with Type K thermocouple wires in the mold in order to measure solidification rates in the chilled and the non-chilled regions of the casting as well as to measure heating rates during heat treatment.

The grate casting consists of 5 bars 1.25×0.75 inch in cross-section×17 inches long. Cross-bars connect all five on both ends. The casting is gated from one end and a steel chill runs across all five bars ¾ of the way from the gate to the far end of the casting.

TABLE 1

| Alloy Chemistry | | | | | |
|---|---|---|---|---|---|
| Si | Fe | Cu | Mn | Mg | Ti |
| 6.6 | 0.4 | 3.9 | 0.57 | 0.43 | 0.12 |

TABLE 2

| Measured Heating Rates | | |
|---|---|---|
| | Setpoint 360° F. | Setpoint 480° F. |
| Fluidized Bed | 2.8° F./s | 1.2° F./s |
| Air | 0.6° F./s | 0.3° F./s |
| Air (Wrapped) | 0.1° F./s | 0.05° F./s |

Heating rates are calculated from the average time to heat from 100° F. to 340 or 450° F.

All castings were solution treated at 923° F. in a fluidized sand bed for 270 minutes and then quenched into a sand bed at 72° F. and held until they reached ambient temperature (about 20 minutes). The castings were naturally aged for 24 hours and then placed into the first age treatment; three were aged in the fluidized bed, three in the forced air oven and three were wrapped in a fiber blanket and placed in the forced air oven, all at 480° F. Due to the different heating rates, the total cycle differed for each condition, but all were held at 480° F. for 30 minutes and then removed and allowed to air cool. After another 24 hours of natural aging, the castings were re-sorted into three groups consisting each of one casting from the fluidized bed, one from the air furnace and one that was wrapped. These three groups were aged a second time under the three heating conditions, but held at 360° F. for six hours. Finally the castings were removed and allowed to cool in ambient air. The bars were sectioned from the castings, both near the chill and away from the chill, machined and tensile tested at room temperature.

Results

Each condition yielded five chilled bars and five unchilled bars. Two of each were used for Brinell Hardness testing (one after age cycle 1 and the other after age cycle 2) and three of the heat treated bars were machined into tensile bars and pulled to failure utilizing an extensometer in the gage length to measure tensile elongation.

Discussion

The conventionally heat treated points given in FIGS. 5 through 8 are taken from the same alloy and same casting configuration but heat treated to a fully hardened T6 condition using air furnace for solution (920° F. for 8 hours) and age (380° F. for 8 hours) and in the overage (T7) condition (same solution and quench then age at 440° F. for 6 hours). These were water quenched, compared to a slower sand quench for the sequentially aged samples. The higher hardness, higher yield strength and lower tensile elongation all indicate the conventionally T6 treated castings are near the tensile strength limit for that process. Likewise the lower hardness and strength combined with higher elongation indicate an overaged condition in the T7 condition.

For both the conventional T6 and the highest heating rate used in both age steps on unchilled specimens, the tensile elongation was insufficient to determine a yield strength (<0.2%).

Hardness

Figure 5:
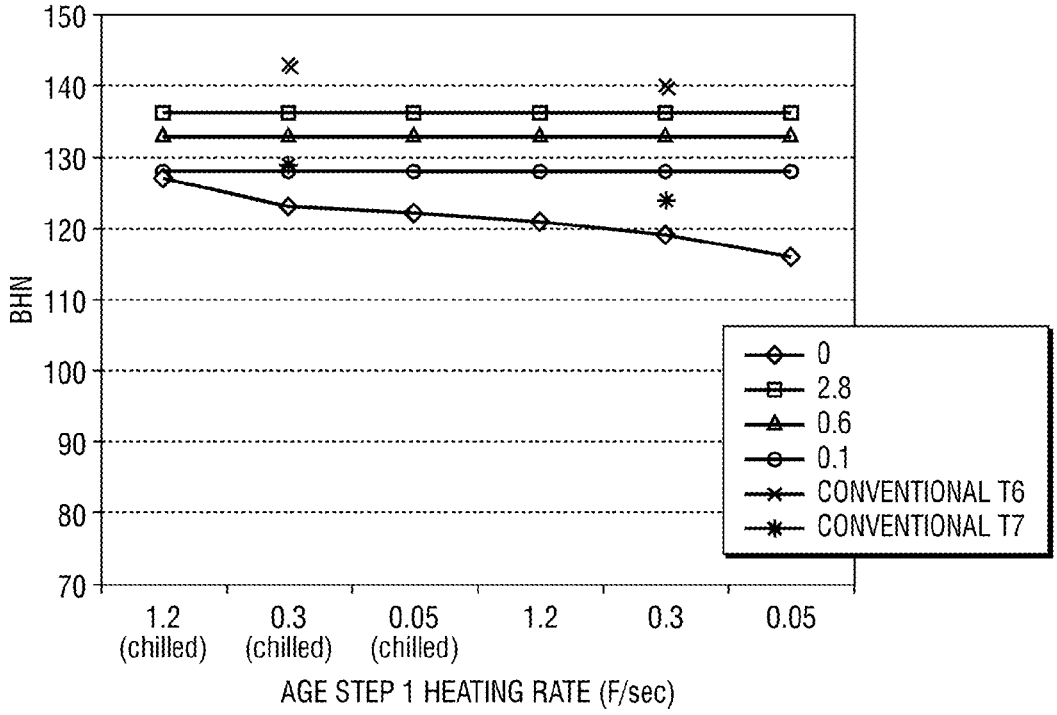
FIGS. 5-8 illustrate the benefits of the step aged process versus conventional aging in chilled and non-chilled castings.

FIG. 5 shows a graph of all of the hardness data. The x's show the conventionally aged specimens for reference and the solid diamonds show the hardness after the first age step. After the first treatment it can be seen that the faster heat-up time results in higher hardness for both chilled and non-chilled microstructures. This occurs even though the total amount of precipitation would be expected to be greater in the more slowly heated samples. In addition, after the second aging treatment, the effect of the stage 1 heating rate appears to be completely eliminated (all three curves are horizontal—showing no relationship to stage 1 heating rate). However, the lines show a direct relationship to the stage 2 heating rate, with faster heating again favoring higher hardness. Neither of these conditions follow the conventional rule where hardness increases with age time at temperature, passes through a maximum and then decreases as the metal becomes "over-aged."

Tensile Strength

Figure 6:
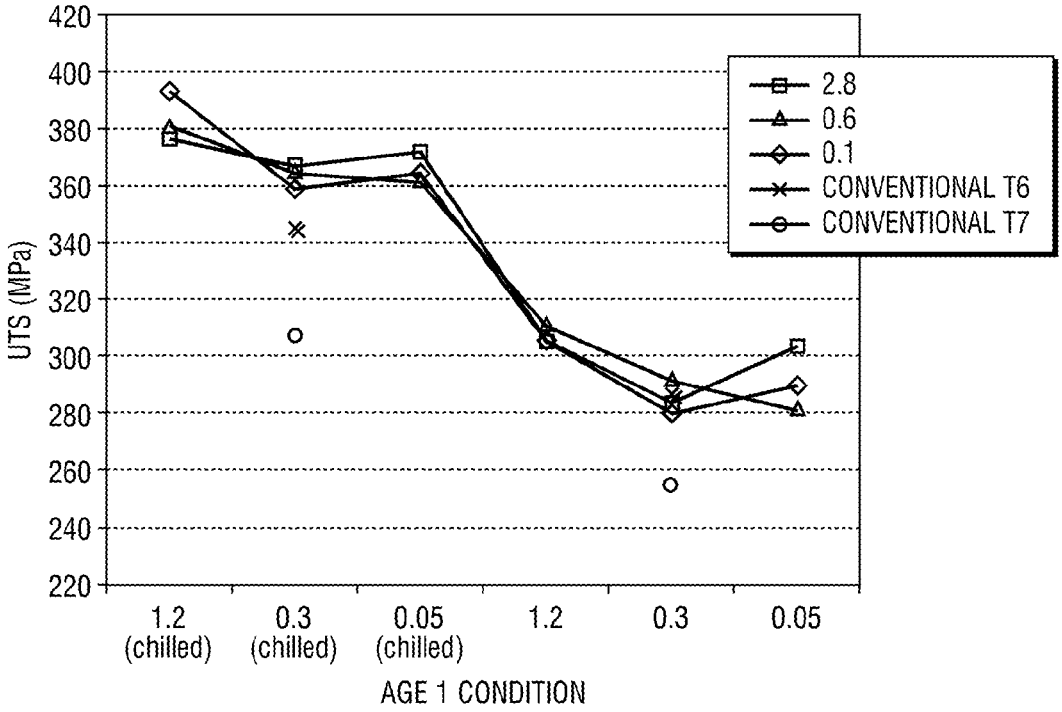
Figure 7:
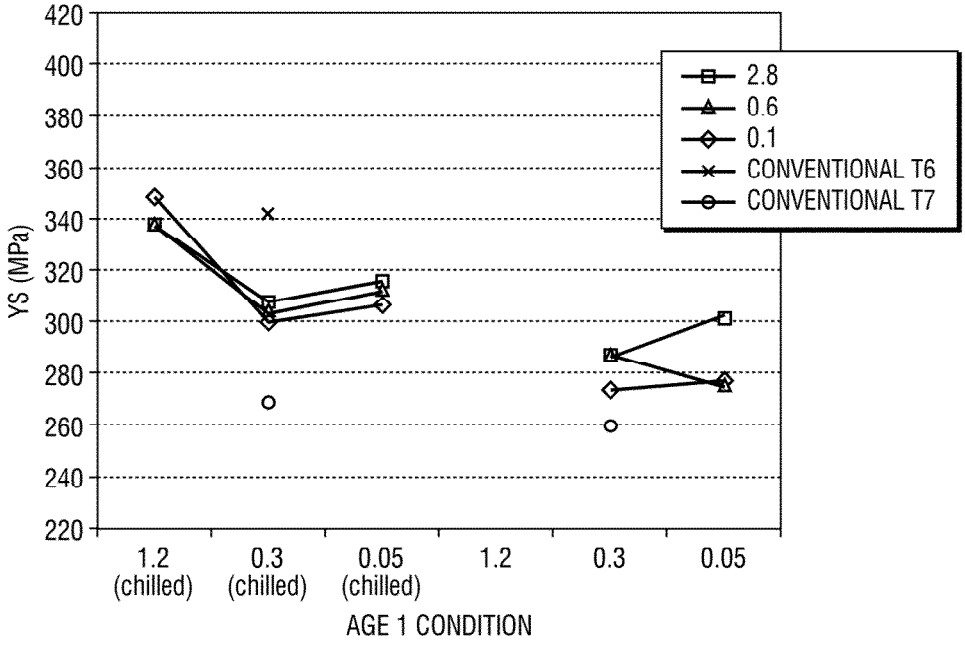
Figure 8:
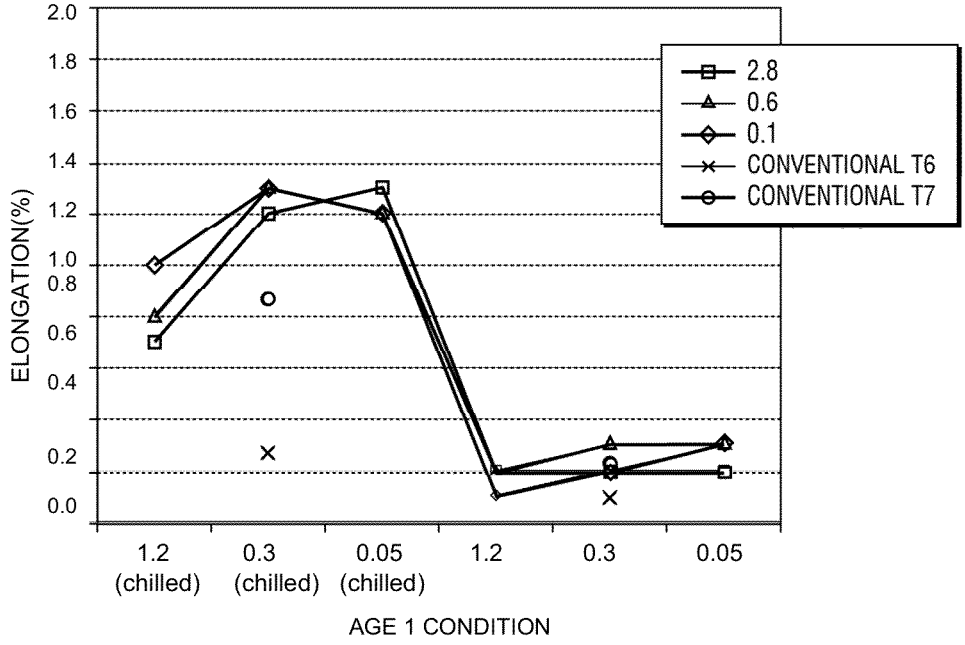

FIGS. 6, 7 and 8 give the ultimate tensile strength, yield strength and tensile elongation, respectively, for all of the conditions tested. The most striking fact is that a sequential age treatment, regardless of heating rate gives a superior combination of tensile properties, particularly tensile elongation. The data shows the general truism that higher elongation results in lower yield strength. However, the data also shows that utilizing the age nucleation treatment shifts the potential strength and elongation values to a significantly higher regime. With higher heating rate furnace technologies, this new property regime is available for commercial application. In fact, a combination of properties that achieves higher tensile strength than T6 and higher tensile elongation than T7 at the same time has been achieved.

The difference in properties between a chilled and non-chilled microstructure is still striking. However, when an age nucleation step is added to the heat treat cycle, we find the possibility to produce significant levels of tensile elongation, resulting in yield strength levels approaching that found in chilled microstructures.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of using a multiple step artificial aging process for an automotive engine component made from an aluminum silicon alloy casting comprising relatively thick regions and relatively thin regions, the method comprising:

a) solution heat treating the casting to dissolve alloying elements, following by cooling;

b) rapidly heating the casting to a nucleation temperature in a range of 400° F. to 500° F. at a rate of at least 1.5° F./min such that a heating rate differential between the relatively thick regions and relatively thin regions is no greater than 7° F./min, and holding at a temperature at least equal to the nucleation temperature for a time sufficient to induce nucleation throughout the casting;

c) cooling the casting to a temperature about 100° F. or more lower than the nucleation temperature, d) heating the casting to a temperature lower than the nucleation temperature to facilitate growing precipitates as distinct phase in the casting, and e) cooling the casting to ambient temperature.

2. The process of claim 1, wherein the Brinell hardness of the casting decreases and the tensile strength and elongation both increase relative to a single-step aging process.

3. The process of claim 1, wherein a liquid heat treating medium or a fluidized bed furnace is used to achieve the rapid heating.

4. The process of claim 1, wherein the differential time to temperature is lowered by contacting heavier sections of the casting with an increased volume of hot fluid.

5. The process of claim 1, wherein the heating rate of the casting in step b) is minimally 1° F./s averaged over the heating time to the nucleation temperature.

6. The process of claim 1, wherein the heating rate of the casting in step d) is minimally 1.5° F./s averaged over the heating time to the precipitate growth temperature.

7. The process of claim 1, wherein the temperature in step c) is sufficiently low such that precipitate growth does not occur.

8. The process of claim 7, wherein the cooling rate is a cooling rate more rapid than that obtained in a forced air furnace.

9. The process of claim 8, wherein cooling is accomplished in a liquid, in a fluidized bed, by impingement of a gas jet, or a combination thereof.

10. The process of claim 1, wherein in step c) the casting is cooled to a temperature lower than that required to grow precipitates, and the casting is reheated in step d) to a temperature sufficient for growth of precipitates.

11. The process of claim 1, wherein following nucleation in step b) precipitate growth in the casting is rapidly quenching to a temperature at which growth of precipitates is interrupted, followed by precipitate growth at a temperature lower than the nucleation temperature.

12. The process of claim 1, wherein a slowest heating section of the casting reaches the nucleation temperature in 100 minutes or less.

13. The process of claim 1, wherein a slowest heating section of the casting reaches the nucleation temperature in 60 minutes or less.

14. The process of claim 1, wherein a slowest heating section of the casting reaches the nucleation temperature in 30 minutes or less.

15. The process of claim 1, wherein the average heating rate to nucleation temperature in step b) is ≥5° F./minute.

16. The process of claim 1, wherein the average heating rate to nucleation temperature in step b) is ≥3° F./minute.

17. The process of claim 1, wherein the heating rate differential in step b) is less than 5° F./minute.

18. The process of claim 1, wherein the differential between the heating rates of the thin and thick sections in step d) is less than 7° F./minute.

19. The process of claim 1, wherein the multiple step ageing process results in both a higher tensile strength than a T6 aged casting and a higher tensile elongation than a T7 aged casting.

* * * * *